US006550413B2

(12) United States Patent
Fiorentino et al.

(10) Patent No.: US 6,550,413 B2
(45) Date of Patent: Apr. 22, 2003

(54) STABILIZER RING FOR A SEA ANCHOR

(76) Inventors: Jenero Fiorentino, 311 E. 22nd St., San Pedro, CA (US) 90731; Zack D. Smith, 3436 66 Ave. SW., Olympia, WA (US) 98512

( * ) Notice: Subject to any disclaimer, the term of this patent is extended or adjusted under 35 U.S.C. 154(b) by 0 days.

(21) Appl. No.: 09/738,183

(22) Filed: Dec. 15, 2000

(65) Prior Publication Data

US 2002/0073908 A1 Jun. 20, 2002

(51) Int. Cl.[7] ..... B63B 21/48
(52) U.S. Cl. ..... 114/311; 244/31
(58) Field of Search ..... 114/311, 249, 114/253; 244/31; 24/241 A

(56) References Cited

U.S. PATENT DOCUMENTS

| | | | | | |
|---|---|---|---|---|---|
| 2,310,359 | A | * | 2/1943 | Finlayson et al. | 24/115 H |
| 2,861,534 | A | | 11/1958 | Fehlner | |
| 3,134,355 | A | | 5/1964 | Jakosky et al. | |
| 3,417,725 | A | | 12/1968 | Fisher | |
| 4,481,900 | A | | 11/1984 | Rutten et al. | |
| 4,562,788 | A | | 1/1986 | Abernethy | |
| 4,632,051 | A | | 12/1986 | Raymond et al. | |
| 4,637,330 | A | | 1/1987 | Shewmon | |
| 4,653,219 | A | | 3/1987 | Kaupert | |
| 4,766,837 | A | | 8/1988 | Parish | |
| 4,969,413 | A | | 11/1990 | Abernethy | |
| 5,016,556 | A | | 5/1991 | Abernethy | |
| 5,025,746 | A | | 6/1991 | Boulter | |
| 5,241,922 | A | | 9/1993 | Allen | |
| 5,463,971 | A | | 11/1995 | Abernethy | |
| D429,996 | S | * | 8/2000 | Fiorentino | D8/356 |
| 2001/0005000 | A1 | * | 6/2001 | Christophe | 244/31 |

FOREIGN PATENT DOCUMENTS

| | | |
|---|---|---|
| FR | 933.634 | 4/1948 |

OTHER PUBLICATIONS

Para–Tech Sea Anchors, 1998.

* cited by examiner

*Primary Examiner*—Jesus D. Sotelo

(57) ABSTRACT

The present invention is a stabilizer ring for a sea anchor, in particular a parachute sea anchor. The preferred embodiment of the stabilizer ring comprises a ring supporting a domed arch. The domed arch has two arch supports that divide the ring into a plurality of sections. Each arch support has a vertex and the two arch supports are connected at their vertices. The domed arch is pivotally connected to a swivel. The swivel has two loops pivotally connected by a bolt.

2 Claims, 5 Drawing Sheets

STABILIZER RING FOR A SEA ANCHOR

TECHNICAL FIELD

The present invention is a stabilizer ring for a sea anchor, in particular a parachute sea anchor.

BACKGROUND ART

Generally, a sea anchor is an object towed by a vessel to keep the bow of the vessel headed into surf or heavy sea or merely to reduce the drift of the vessel. A sea anchor is not generally designed to anchor to the bottom of a body of water and hold fast as a conventional anchor operates. A number of sea anchors, boat drags and/or drogues are known including U.S. Pat. Nos. 3,134,355, 3,417,725, 4,481,900, 4,562,788, 4,632,051, 4,637,330, 4,653,219, 4,969,413, 5,016,556, 5,025,746, 5,241,922, and 5,463,971. The most common sea anchors are cone shaped and parachute-shaped canopies made of cloth or canvas. The canopies are usually attached by a plurality of shroud lines to a single line or chain that is in turn attached to the vessel deploying the sea anchor.

Several common problems can occur with prior art sea anchors, in particular during heavy weather or rough seas. These problems can include fouled shroud lines, collapsed canopies, shroud line chafing and general difficulty in deploying the sea anchor. Thus, a stabilizer is needed that will reduce or eliminate these common sea anchor problems.

SUMMARY OF THE INVENTION

The present invention is a stabilizer ring for a sea anchor, in particular a parachute sea anchor. The preferred embodiment of the stabilizer ring comprises a ring supporting a domed arch. The domed arch has two arch supports that divide the ring into a plurality of sections. Each arch support has a vertex and the two arch supports are connected at their vertices. The domed arch is pivotally connected to a swivel. The swivel has two loops pivotally connected by a bolt.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

DETAILED DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the general principles of the present invention have been defined herein specifically to provide a stabilizer ring for a sea anchor.

Figure 1:
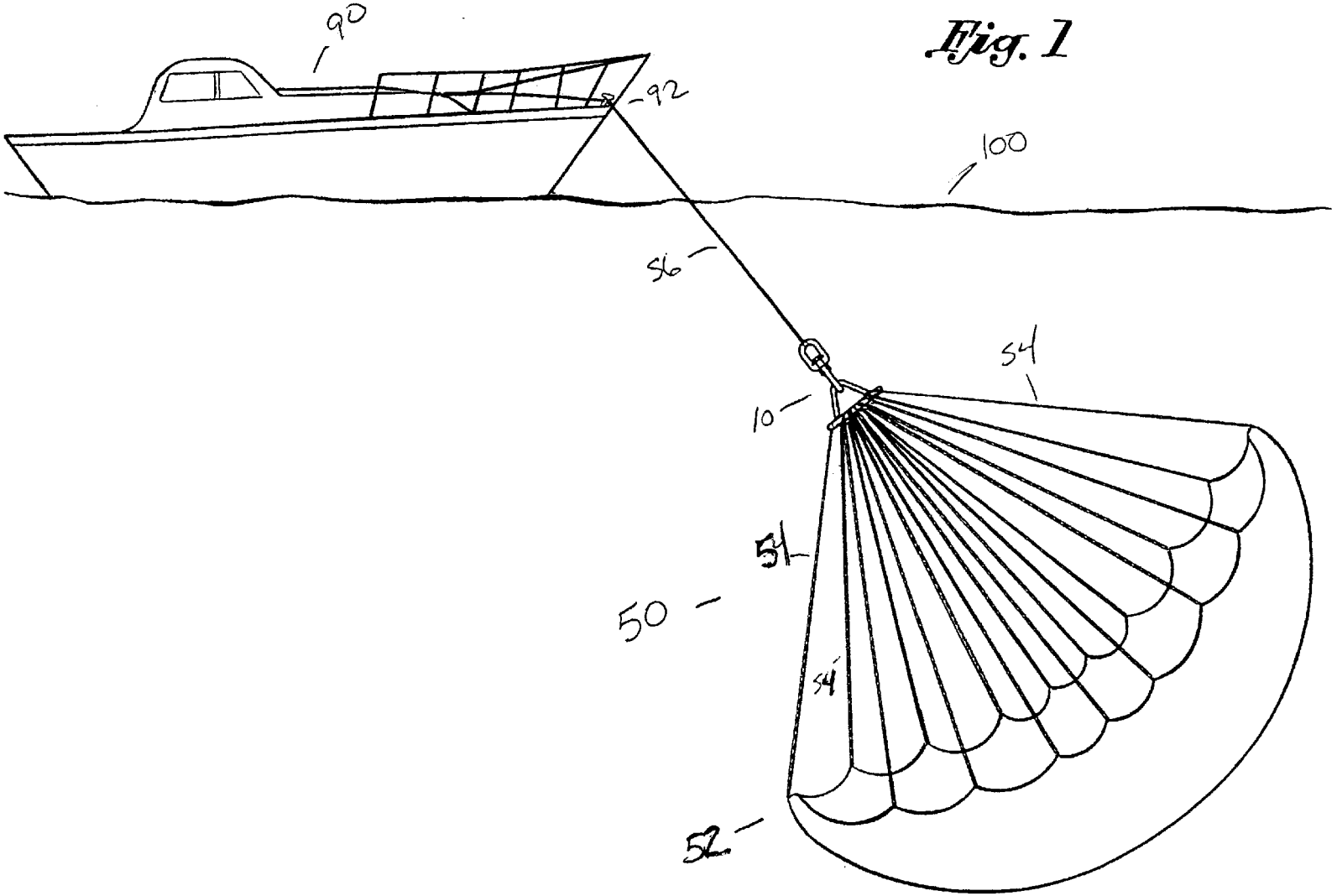
FIG. 1 is a view of a preferred embodiment of the invention deployed from a boat in a body of water.

Referring now to FIG. 1, a preferred embodiment of the invention 10 is shown deploying a parachute sea anchor 50 in a body of water 100. The parachute sea anchor 50 has a canopy 52 attached to a plurality of shroud lines 54. The shroud lines 54 are attached to a stabilizer ring 10. The stabilizer ring 10 is attached to a flexible line 56. The flexible line 56 is attached to a boat 90 at its bow 92.

Figure 2:
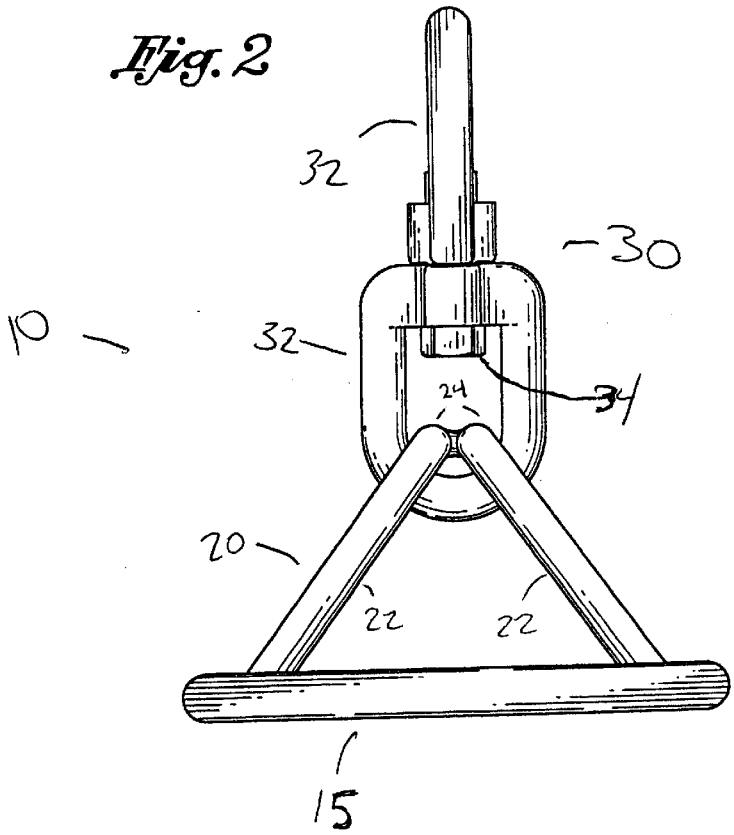
FIG. 2 is a side view of a preferred embodiment of the invention.

FIG. 2 shows a side view of a preferred embodiment of the stabilizer ring 10. The stabilizer ring 10 comprises a ring 15 supporting a domed arch 20. Preferably, the domed arch comprises two support arches 22. Each support arch 22 has a vertex 24. The two support arches 22 are connected at the vertices 24. Preferably, the two support arches 22 are connected at the vertices 24 and to the ring 15 by welding. However, these items can also be made as a unitary construction.

Figure 4:
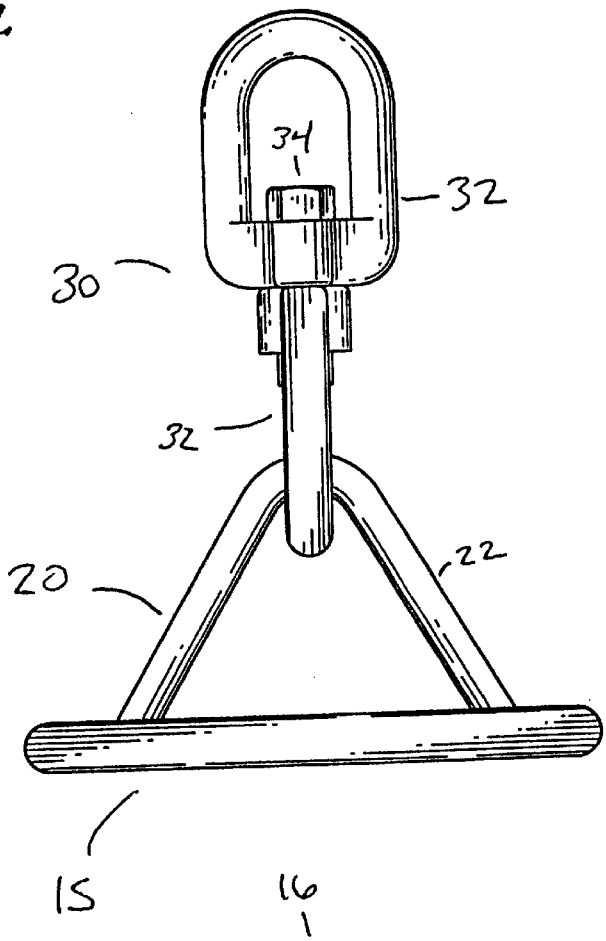
FIG. 4 is another side view of a preferred embodiment of the invention.

The domed arch 20 is pivotally connected to a swivel 30. The swivel 30 preferably comprises two loops 32. The loops 32 are pivotally connected, preferably by a bolt 34. FIG. 4 shows another side view of a preferred embodiment of the invention including the swivel 30 and the domed arch 20. The swivel 30 allows the stabilizer ring 10 to adjust to varying wave and weather conditions to maintain an inflated canopy 52 and shroud line 54 integrity.

Figure 3:
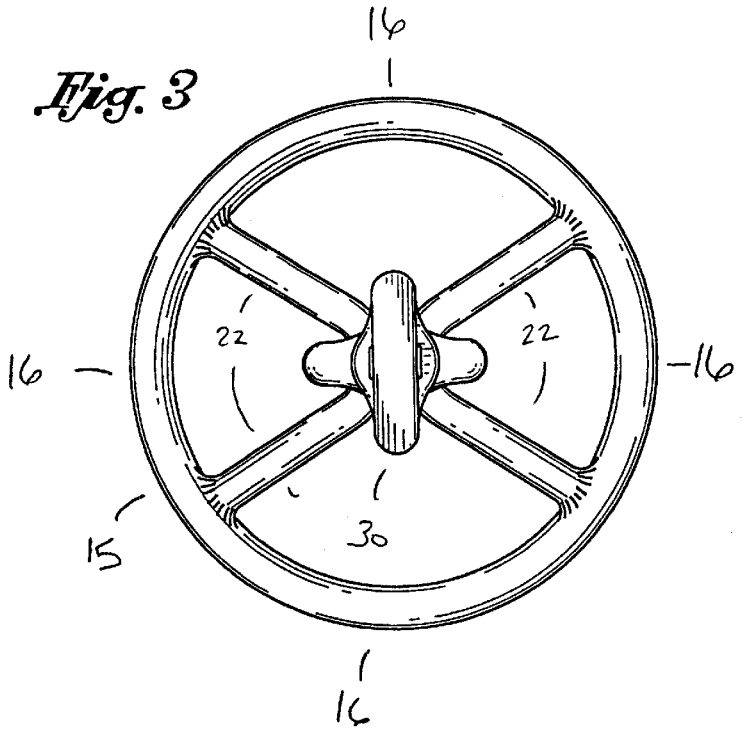
FIG. 3 is a top view of a preferred embodiment of the invention.
Figure 5:
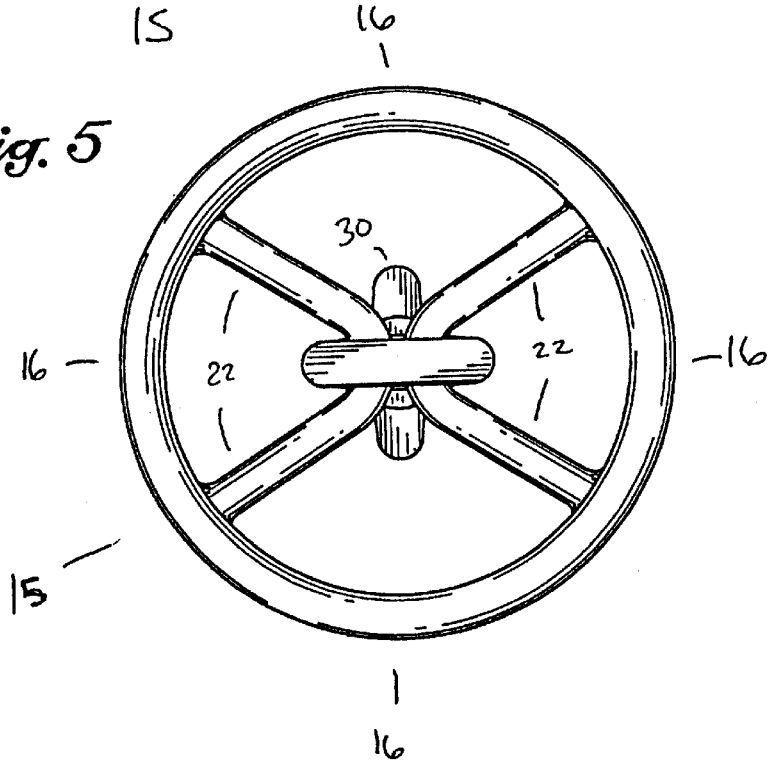
FIG. 5 is a bottom view of a preferred embodiment of the invention.

Referring now to FIGS. 3 and 5, a top view and bottom view of a preferred embodiment of the invention is shown. As shown, the ring 15 is divided into sections 16, preferably equal sections, along its circumference by the support arches 22. Preferably, equal numbers of shroud lines 54 are attached to each section 16 of the ring 15. The shroud lines 54 are dispersed in a circular pattern about the ring 15. This disperses tension more equally to each of the shroud lines 54 when the sea anchor 50 is deployed. This increases the overall strength of the sea anchor, improves ease and speed of deployment, reduces line chafe, and reduces the chances of the canopy 50 collapsing from increased pull to one side of the ring 15.

Preferably, the stabilizer ring 10 is constructed from 304 stainless steel for its resistance to corrosion and its strength. The preferred embodiment of the invention has a ring 15 that is ⅝" diameter 304 stainless steel. The preferred embodiment of the invention has support arches 22 that are ½" diameter stainless steel. However, the stabilizer ring 10 can be constructed from a variety of materials such as metal, plastic and/or wood and still be operational.

The stabilizer ring 10 can be used in conjunction with a variety of canopy 50 shapes for sea anchors including a parachute shape as shown in FIG. 1. Also, a canopy 50 can be cone-shaped. The preferred embodiment of the stabilizer ring 10 is also of sufficient weight such that the flexible line 56 does not need to be a chain. Instead, the flexible line 56 can be rope. However, chain can be used as the flexible line 56 regardless.

Figure 6:
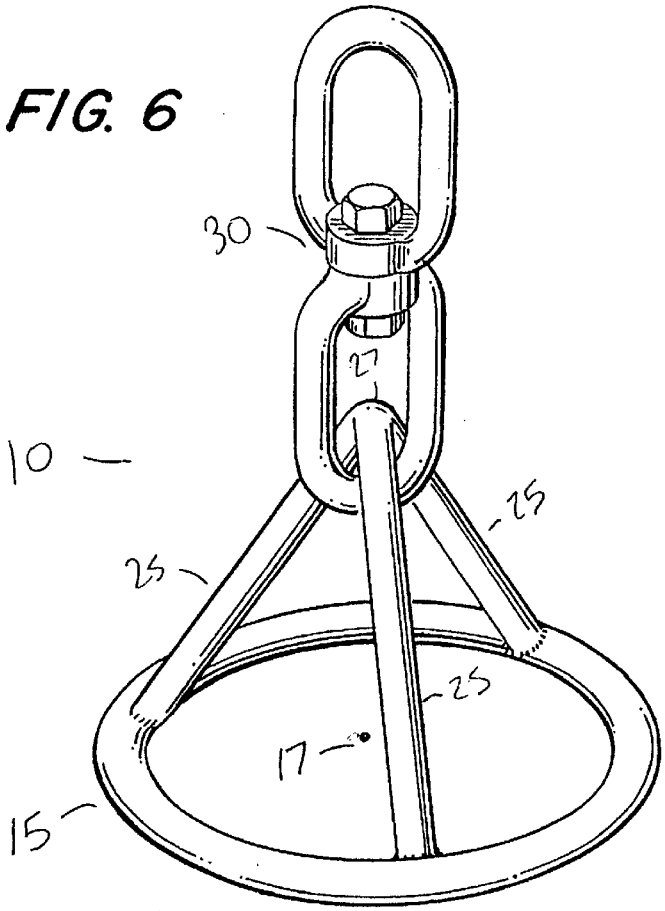
FIG. 6 is a side view of an alternative embodiment of the invention.
Figure 7:
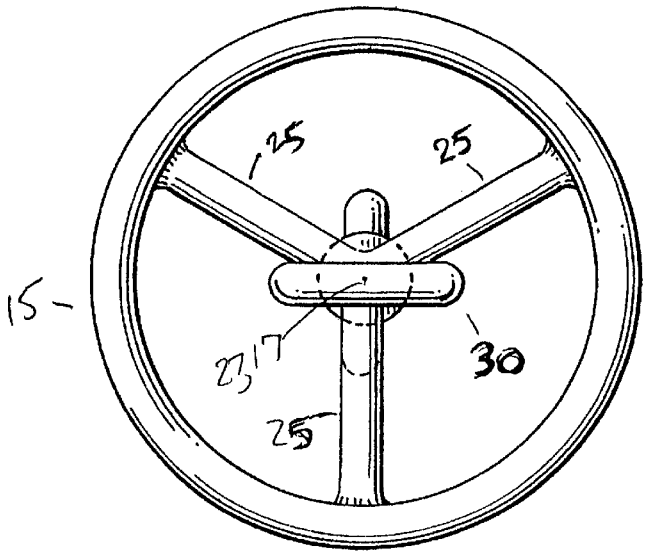
FIG. 7 is a bottom view of an alternative embodiment of the invention.

An alternative embodiment of the invention is also available as shown in FIGS. 6 and 7. The stabilizer ring 10 comprises a ring 15 with a center 17 supporting three posts 25 (at least a plurality of posts 25) extending from the ring 15 and meeting at a vertex 27 positioned above the center of the ring 17. The posts 25 are, as described above in the previous embodiment, pivotally connected to a swivel 30.

Figure 8:
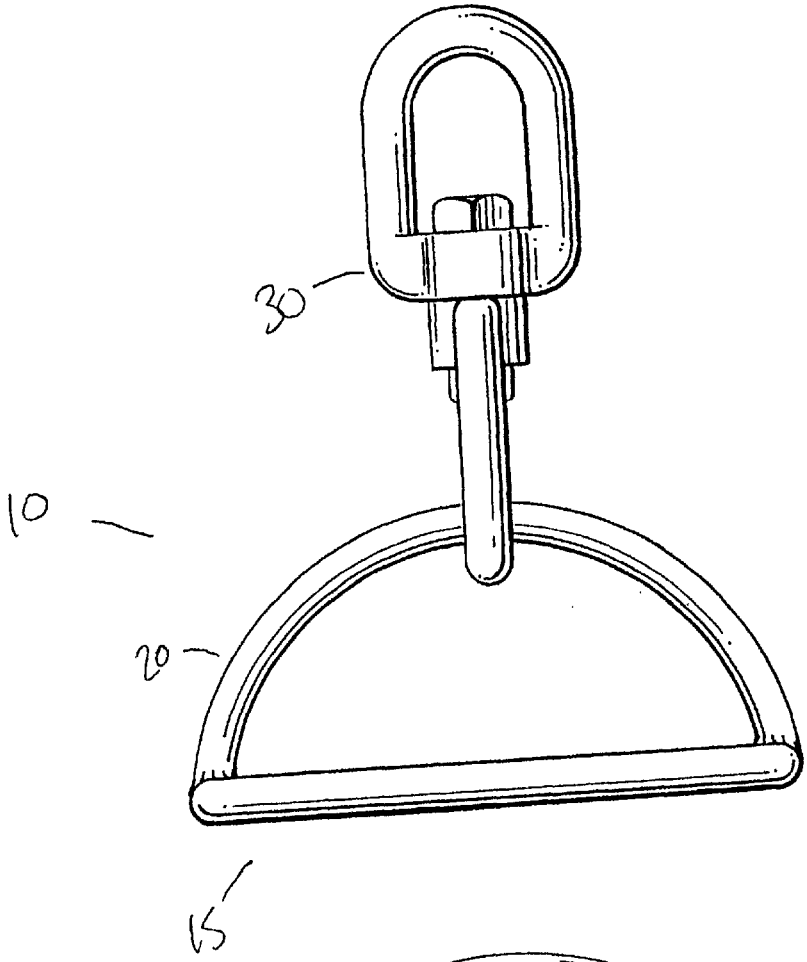
FIG. 8 is a side view of an alternative embodiment of the invention.
Figure 9:
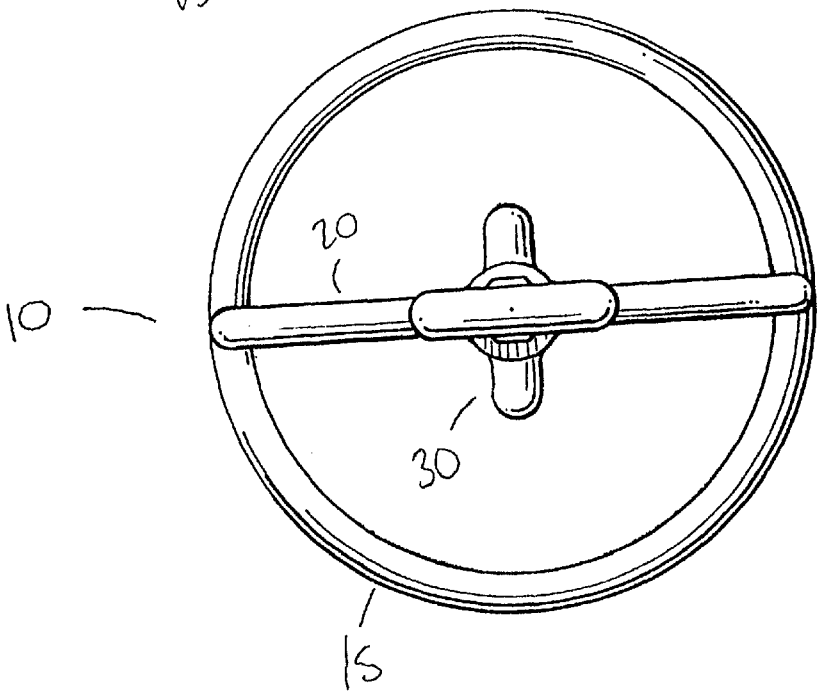
FIG. 9 is a top view of an alternative embodiment of the invention.

Another alternative embodiment of the invention is available as shown in FIGS. 8 and 9. The stabilizer ring 10 comprises a ring 15 supporting a single arch 20 extending across a diameter of the ring 15. The arch 20 shown in FIGS. 8 and 9 is rounded in shape. However, the arch 20 can have other shapes such as a V-shape. The arch 20 is, as described above in the previous embodiments, preferably pivotally connected to a swivel 30.

Thus, a stabilizer ring for a sea anchor is described above that reduces or eliminates common problems associated with sea anchors including fouled shroud lines, collapsed canopies, shroud line chafing and difficulty in deployment of the sea anchor. In each of the above embodiments, the different positions and structures of the present invention are described separately in each of the embodiments. However, it is the full intention of the inventor of the present invention that the separate aspects of each embodiment described herein may be combined with the other embodiments described herein. Those skilled in the art will appreciate that adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. A stabilizer ring for a sea anchor comprising a ring supporting a domed arch; where the domed arch has two arch supports, each arch support having a vertex, where the two arch supports are connected at the vertices.

2. A stabilizer ring for a sea anchor comprising a ring supporting a domed arch having two arch supports whereby the two arch supports divide the ring into a plurality of sections, each arch support having a vertex, where the two arch supports are connected at the vertices, said domed arch pivotally connected to a swivel having two loops pivotally connected by a bolt.

* * * * *